US006501359B2

(12) United States Patent
Matsusaka et al.

(10) Patent No.: US 6,501,359 B2
(45) Date of Patent: Dec. 31, 2002

(54) ELECTROMAGNETIC ACTUATOR

(75) Inventors: Noboru Matsusaka, Kariya (JP); Hideyuki Sato, Obu (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 09/948,568

(22) Filed: Sep. 10, 2001

(65) Prior Publication Data

US 2002/0057153 A1 May 16, 2002

(30) Foreign Application Priority Data

Sep. 20, 2000 (JP) ..... 2000-284633

(51) Int. Cl.[7] ..... H01F 7/00

(52) U.S. Cl. ..... 335/278; 335/255; 29/602.1; 29/606

(58) Field of Search ..... 335/255, 257, 335/258, 260, 278, 281; 29/602.1, 606–609

(56) References Cited

U.S. PATENT DOCUMENTS 4,809,749 A 3/1989 Ichihashi ..... 137/625.65

5,687,698 A * 11/1997 Mastro et al. ..... 123/568.26

OTHER PUBLICATIONS

Oishi et al, U.S. application Ser. No. 09/597,819, filed Jun. 19, 2000.

* cited by examiner

*Primary Examiner*—Ramon M. Barrera
(74) *Attorney, Agent, or Firm*—Nixon & Vanderhye PC

(57) ABSTRACT

In a solenoid portion of a solenoid valve, a fixed core for axially attracting a plunger due to magnetic force generated by a magnetic coil is divided into two. One is a cylindrical yoke having an opening at an axial end and a bottom at the other axial end. The other one is a cylindrical stator core having a flange protruding radially outwardly at an axial end thereof. The bottom of the yoke is provided with a thick body portion having a center recess. The inner surface of the opening of the yoke is fitted to an outer surface of the flange and the inner surface of the recess of the thick body portion is fitted to an outer surface of the stator core. Accordingly, constructions of molding dies for manufacturing the yoke and the stator core are simple. Further, only limited surfaces of the yoke and the stator core, which are fitted to each other, need accurate dimensions so that magnetic gap is minimized.

10 Claims, 8 Drawing Sheets

ELECTROMAGNETIC ACTUATOR

CROSS REFERENCE TO RELATED APPLICATION

This application is based upon and claims the benefit of priority of Japanese Patent Application No. 2000-284633 filed on Sep. 20, 2000, the content of which is incorporated herein by reference.

BACKGROUND OF THE INVENTION

1. Field of the Invention

The present invention relates to an electromagnetic actuator having a coil bobbin, a magnetic coil, a yoke, a fixed core and a moving core, which is a solenoid valve applicable, in particular, to a hydraulic control apparatus of an automatic transmission for vehicles.

2. Description of Related Art

Conventionally, in an electromagnetic actuator for driving a spool accommodated to move axially in a housing that is provided in a hydraulic system circuit of an automatic transmission for a vehicle, as shown in FIG. 9, a solenoid portion 100 is composed of a stator core 101, a coil bobbin 102 fixed to a radial outer circumference of the stator core 101, a magnetic coil (solenoid coil) 103 wound on the coil bobbin 102, a moving core housed inside the stator core 101 and a yoke 105 positioned on an outer circumferential side of the magnetic coil 103. The moving core 104 is attracted axially in the stator core 101 by magnetic force exerted on energizing the magnetic coil 103.

The coil bobbin 102 and the magnetic coil 103 constitute a coil assembly 106. The stator core 101, which is arranged on inner circumferential side of the coil assembly 106, has first and second flanges 111 and 112 between which the coil assembly 106 is axially sandwiched. The coil bobbin 102 has first and second flange portions 121 and 122 between which the magnetic coil 103 is wound. The yoke 105 is shaped as a cylinder having a bottom wall 151 at an axial end thereof.

According to the conventional solenoid portion 100, the stator core 101 is manufactured by plastic working (cold forging) in use of separable molding dies whose constructions are complicated since the stator core 101 is provided at axial opposite ends thereof with the first and second flanges 111 and 112. Accordingly, the conventional stator core 101, whose manufacturing is not easy from a standpoint of its construction, has a drawback that the manufacturing cost is higher. Further, in the conventional solenoid portion 100, each dimensional accuracy of an inner diameter of the yoke 105 and an outer diameter of the stator core 101 over a whole axial length thereof is required when the stator 101 is assembled to the yoke 105 because it is important for securing better product performance to minimize a magnetic gap between the outer circumference of the stator core 101 and the inner circumference of the yoke 105, resulting in lower working efficiency and less manufacturing productivity.

SUMMARY OF THE INVENTION

In view of the above-described problem, it is an object of the present invention to provide an electromagnetic actuator having first and second magnetic elements to be manufactured without using dividable complicated molding dies so that the manufacturing cost of the electromagnetic actuator is lower.

It is an aspect of the present invention to provide the electromagnetic actuator in which a magnetic gap between the first and second magnetic element is minimized so that product performance of the actuator is improved.

To accomplish the above-described object, the electromagnetic actuator has a magnetic coil for generating magnetic force when energized, a cylindrical resin molding member having first and second flange portions between which the magnetic coil is wound, a moving core positioned at a radial inside of the resin molding member and axially movable due to the magnetic force generated on energizing the magnetic coil and first and second magnetic element to be magnetized by the magnetic force generated on energizing the magnetic coil.

With the electromagnetic actuator, the first magnetic element is positioned at a radial outside of the magnetic coil and provided at an inner circumference of an axial end thereof with a first protruding portion extending radially inward. The second magnetic element is disposed between a radial outside of the moving core and a radial inside of the magnetic coil and provided at an outer circumference of an axial end thereof on a side opposite to the axial end of the first magnetic element with a second protruding portion extending radially outward. The first and second flange portions are axially sandwiched between and supported by the first and second protruding portions.

It is preferable that the first magnetic element is provided at the other axial end thereof with an opening whose inner circumference is fitted to an outer circumference of the second protruding portion and the first protruding portion is provided in a center thereof with an inner recess whose inner circumference is fitted to an outer circumference of the second magnetic element. Accordingly, to minimize the magnetic gap, only limited surfaces of the first and second magnetic elements, which are fitted to each other for assembly, need accurate dimensions.

Another object of the invention is to provide a method of manufacturing an electromagnetic actuator whose parts and components are assembled from the same side, resulting in improving assemble efficiency and manufacturing productivity.

To achieve the object, in an electromagnetic actuator having a magnetic coil, a yoke, a moving core and a fixed core, while the yoke made of magnetic material is formed in shape of a cylinder having a bottom at an axial end and an opening at the other axial end, the moving and fixed cores both made of magnetic material are formed in a given shape, respectively. Then, the moving core is assembled to the yoke by axially moving and inserting the moving core into an inside of the yoke from the opening of the yoke toward the bottom thereof. On the other hand, after forming a primary resin part having first and second flange portions on an outer circumference of the fixed core by integral resin molding and, then, winding the magnetic coil on the primary resin part between the first and second flange portions, a secondary resin part is formed over an outer circumference of the magnetic coil by integral resin molding. Accordingly, a coil assembly, in which the magnetic coil and the primary and secondary resin parts are integrated with the fixed core, is completed. Then, the coil assembly is assembled to the yoke by axially moving and inserting the coil assembly into a space between an inner circumference of the yoke and an outer circumference of the moving core from the opening of the yoke toward the bottom thereof.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENT (First Embodiment)

A solenoid valve according to a first embodiment is described with reference to FIGS. 1 to 5D.

Figure 2:
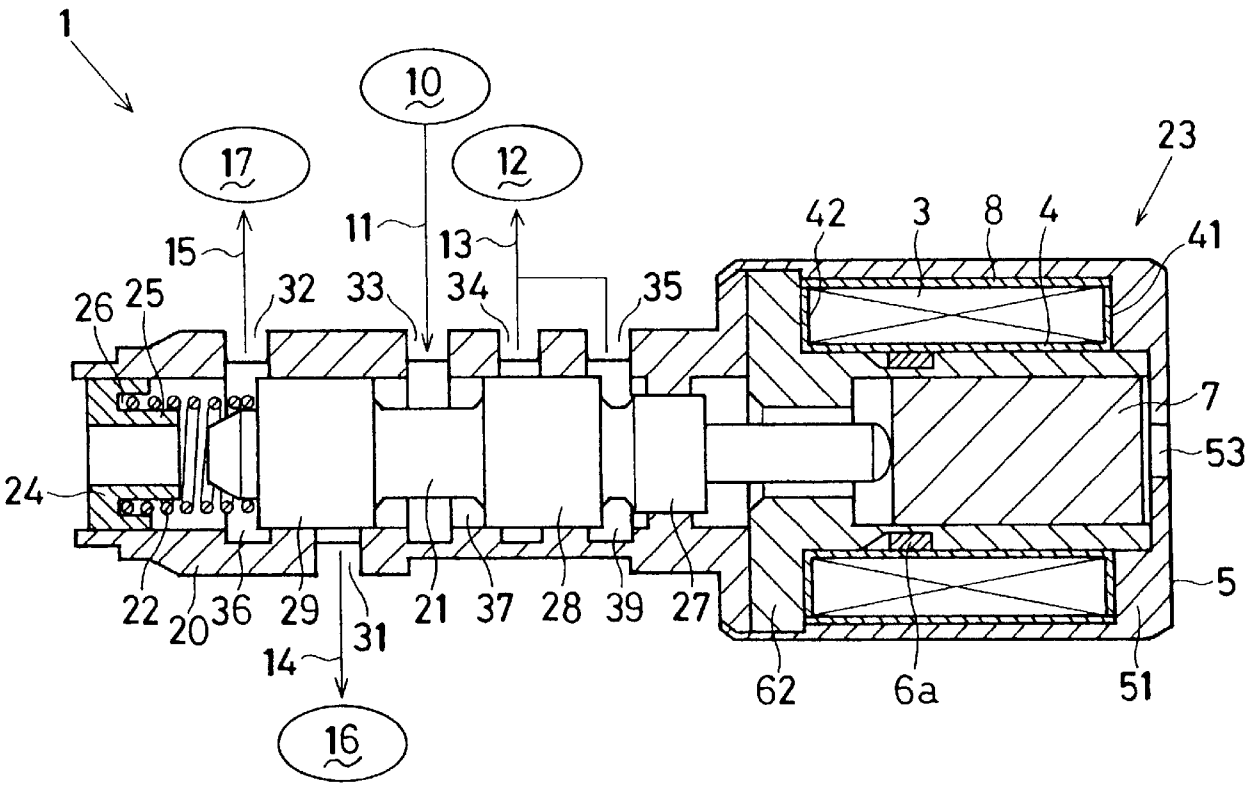
FIG. 2 is a cross sectional whole view of the solenoid valve flow according to the first embodiment.
Figure 3A:
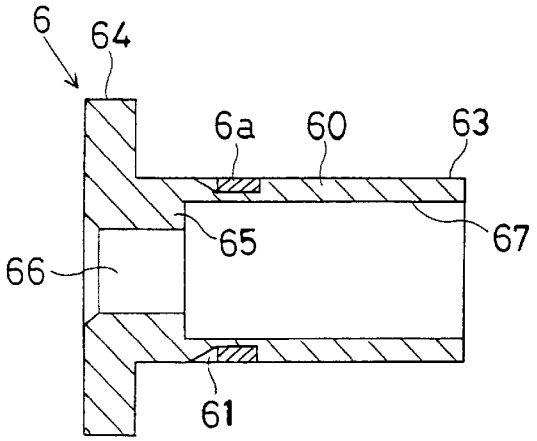
FIG. 3A is a cross sectional view of a stator core of the solenoid portion of FIG. 1.
Figure 3B:
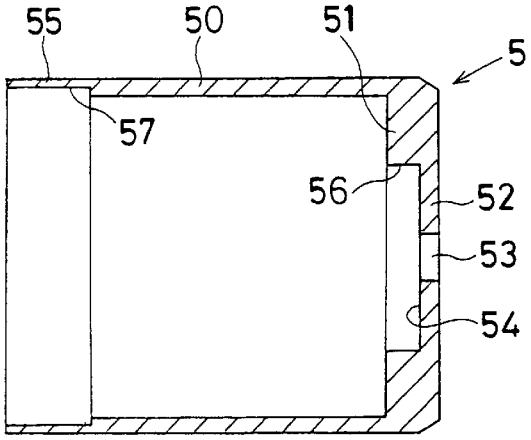
FIG. 3B is a cross sectional view of a yoke of the solenoid portion of FIG. 1.
Figure 4:
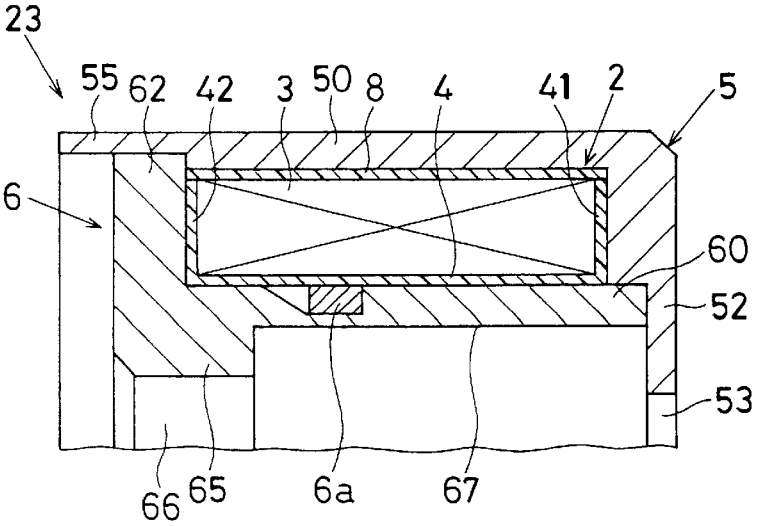
FIG. 4 is an enlarged view of the solenoid portion of a solenoid valve of FIG. 1.
Figure 5A:
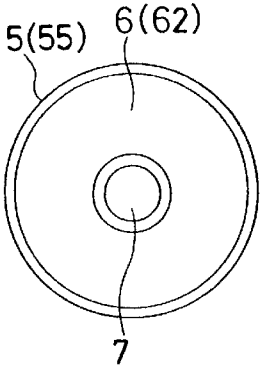
FIG. 5A is a front view of the solenoid portion of FIG. 1.
Figure 5B:
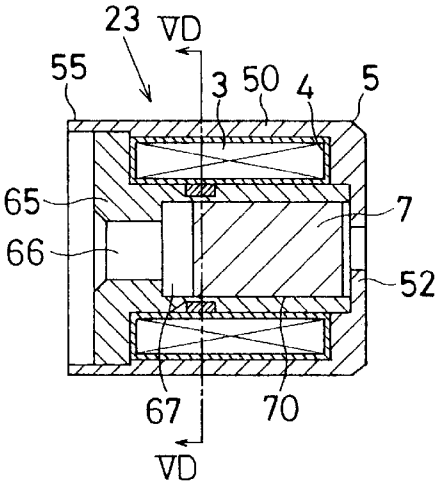
FIG. 5B is a cross sectional view of the solenoid portion of FIG. 1.
Figure 5C:
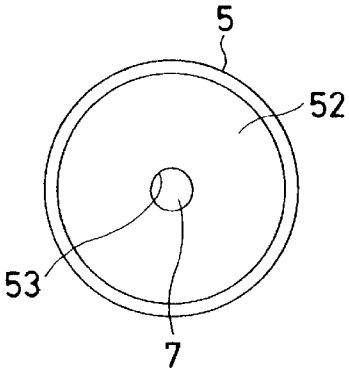
FIG. 5C is a back view of the solenoid portion of FIG. 1
Figure 5D:
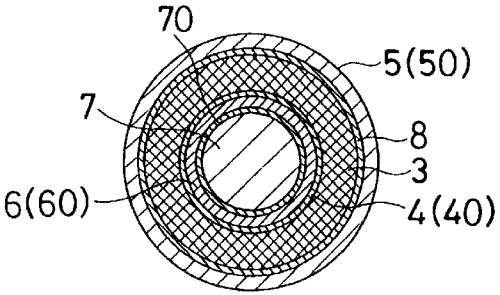
FIG. 5D is a cross sectional view taken along a line VD—VD of FIG. 5B.

As shown in FIG. 2, a hydraulic control apparatus of an automatic transmission installed in a vehicle has a system hydraulic circuit through which output hydraulic pressure equivalent to supply pressure of hydraulic supply source (supply source) 10 is supplied to a solenoid valve 1. The system hydraulic circuit is further provided with a hydraulic conduit 13 through which the solenoid valve 1 communicates with a hydraulic servo 12 for driving a hydraulic pressure engagement element of the automatic transmission.

A multi-plate type frictional clutch is used as the hydraulic pressure engagement element for selectively changing a transmission ratio of an input shaft to an output shaft of the automatic transmission. An oil pump is used as the hydraulic pressure source 10. An engine drives the oil pump so that operation oil sucked from an oil sump via an oil strainer is discharged to a supply pressure (line pressure) hydraulic conduit 11. Drain (low pressure) hydraulic conduits 14 and 15 communicate respectively with first and second drains 16 and 17 such as oil sumps provided in an oil pan.

The solenoid valve 1 is composed of a roughly cylindrical housing (hereinafter referred as "sleeve") 20 accommodated in a recess of a valve body (not shown) in which the system hydraulic circuit of the automatic transmission is formed, an approximately column shaped spool 21 slidably housed in the sleeve 20, a spring 22 biasing the spool 21 toward an initial position, and a solenoid portion 23 axially driving the spool 21. The sleeve 20 is provided at a left end thereof in FIG. 2 with a ring shaped adjusting element 24 for adjusting an initial spring load of the spring 22. The adjusting element 24 has a stopper for restricting a movement of the spool 21 in a left direction in FIG. 2.

The sleeve 20 is further provided with first and second drain ports 31 and 32 which communicate with the drain hydraulic conduits 14 and 15 of the first and second drains 16 and 17, respectively, a supply pressure port (input port) 33 which communicates with the supply pressure hydraulic conduit 11 of the hydraulic pressure source 10, a clutch pressure output port 34 which communicates with the hydraulic conduit 13 of the hydraulic pressure servo 12, and a feedback port 35. A drain hydraulic chamber 36, an output pressure hydraulic chamber 37 and a feedback hydraulic chamber 39 are formed between the sleeve 20 and the spool 21, respectively.

The spool 21 and the sleeve 20 constitute a three ports switching valve for changing over the communication between the supply pressure hydraulic conduit 11 of the hydraulic pressure source 10 and the hydraulic pressure conduit of the hydraulic pressure servo 12 to or from the communication between the supply pressure hydraulic conduit 11 of the hydraulic pressure source 10 and the drain hydraulic conduit 15 of the second drain 17. The spool 21 moves in a left direction in FIG. 2 when a thrust force of the solenoid portion 23 acting on a right end of the spool 21 in FIG. 2 exceeds the biasing force of the spring 22. Further, the spool 21 is provided at outer circumference with a small diameter land 27 and large diameter lands 28 and 28 that are arranged in order from an axial end toward the other axial end.

The output pressure hydraulic chamber 37 is an oil chamber formed by an inner wall of the sleeve 20 and a circumferential groove of the spool 21 locating between the large diameter lands 28 and 29. The feedback hydraulic chamber 39 is an oil chamber formed by an inner wall of the sleeve 20 and a circumferential groove of the spool 21 locating between the small diameter land 27 and the large diameter land 28. The feedback hydraulic chamber 39 gives the small diameter land 27 a feedback force whose biasing direction is same as that of the spring 22. The spring 22 is a coil spring (biasing means) whose one end is held by an end of the spool 21 and whose the other end is held by an annular groove 26 of the adjusting element 24. The spring 22 gives the spool 21 a biasing force in an opposite direction (right direction in FIG. 2) to the thrust force of the solenoid portion 23.

The solenoid portion 23, which is the electromagnetic actuator of the present invention, is composed of a coil assembly 2, a yoke 5 that is shaped as a cylinder having a bottom and fixed to an end of the sleeve 20 of the solenoid valve 1 by staking, a stator core 6 arranged on an inner circumferential side of the yoke 5, and a moving core (hereinafter referred as "plunger") 7 driving integrally the spool 21.

The coil assembly 2 has a magnetic coil (solenoid coil) 3 for exerting a magnetic attracting force when energized, a coil bobbin (primary molding resin part) 4 that is made of electrically insulating resin and on an outer circumference of which (a cylindrical portion 40) the magnetic coil 3 is wound, and a resin element (secondary molding resin part) that is formed at an outer circumference of the magnetic coil 3 and the cylindrical portion 40. The coil bobbin 4 is arranged on a radially outer side of the stator core 6 and is formed in roughly cylindrical shape by resin molding to have a pair of flange portions 41 and 42 at axially opposite ends thereof. The magnetic coil 3 is wound between the flange portions 41 and 42. A connector (not shown) is formed by resin molding integrally with the resin element 8 at a position of the yoke 5 partly exposed to outside. The connector has terminals for connecting in circuit the magnetic coil 3 and a vehicle battery, which are formed by insert molding when the connector is formed.

The yoke 5, which is a first magnetic component, is made of iron base magnetic material and formed in shape of a cylinder having a bottom on an axial side and an opening on the other axial side (roughly in a letter U or one side removed square shape). The yoke 5 has a cylindrical outer wall 50 arranged on a radially outer side of the magnetic coil 3, an annular thick body portion 51 in contact with and for stopping the flange portion 41 of the coil bobbin 4, and an annular bottom wall 52 for closing an axial end of the outer wall 50. The thick body portion 51 is formed integrally with the outer wall 50 at an inner circumference of the outer wall 50 on an axial end thereof. The bottom wall 52 is provided with a vent 53 for ventilation.

Figure 1:
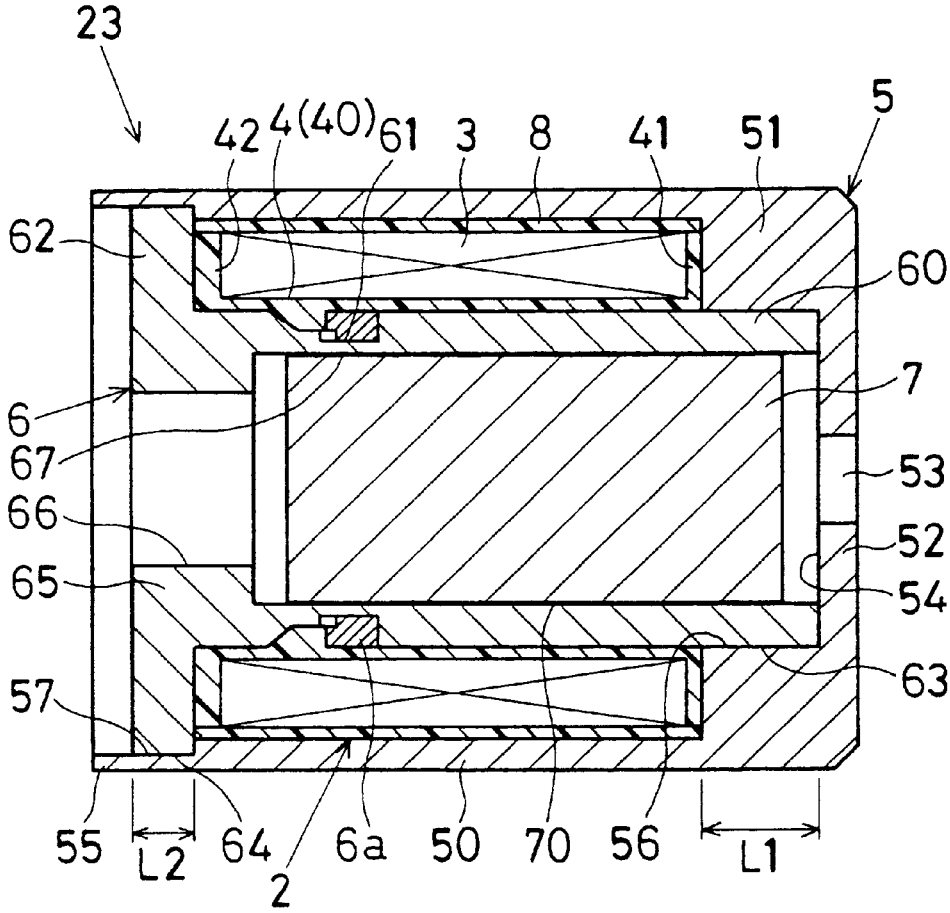
FIG. 1 is a cross sectional view of a solenoid portion of a solenoid valve according to a first embodiment.

A center surface of the bottom wall 52 constitutes a stopper 54 for restricting a movement of the plunger 7 in a right direction in FIG. 1. The thick body portion 51, which is a first protruding portion, is formed integrally with the outer wall 50 at an axial end inner circumference of the outer wall 50. A thin wall portion 55 is formed at the other axial end of the cylindrical outer wall 50 for fixing the yoke 5 to an end of the sleeve 20 by staking. A wall thickness of the cylindrical outer wall 50 is thinner than that of the thin wall portion 55 and smaller than that of the thick body portion 51.

The stator core 6, which constitute a second magnetic component and a fixed core, is maded of iron based magnetic material and formed in nearly cylindrical shape by plastic working (cold forging or pressing). The stator core 6 is provided with a cylindrical inner wall portion 60 located on a radially inner side of the magnetic coil 3 and an annular flange 62, which is a second protruding portion, in contact with and stopped by the flange portion 42 of the coil bobbin 4. The cylindrical inner wall portion 60 is provided at an outer circumference thereof with a groove 61 in which a half dividable permanent magnet 6*a* is housed without interfering with the cylindrical portion 40 of the coil bobbin 4, that is, without protruding outward out of an outer surface of the cylindrical inner wall portion 60. The annular flange 62 is formed integrally with the inner wall portion 60 at an axial end thereof. An outer circumferential surface of the inner wall portion 60 at the other axial end there of constitutes a ring shaped fitting portion 63 (convex or projecting portion) that is fitted to a fitting portion 56 (concave or recess portion) formed on an inner circumferential surface of the thick body portion 51 of the yoke 5. An outer circumferential portion of the flange 62 of the stator core 6 constitutes a fitting portion 64 (convex or projecting portion) that is fitted to a fitting portion 56 (concave or recess portion) formed on an inner circumferential surface of the outer wall portion 50 of the yoke 5.

The fitting portions 63 and 64 and the fitting portions 56 and 57 constitute reference surfaces for assembly, respectively, when the stator core 6 is assembled to the yoke 5. The flange 62 of the stator core 6 is integrally provided at an inner circumferential end thereof with a cylindrical attracting portion 65 toward which the plunger 7 is attracted by a magnetic force generated when the magnetic coil 3 is energized. The attracting portion 65 protrudes radially inward out of the inner circumferential surface of the inner wall portion 60 and is provided in an inside thereof with an axial through-hole 66 through which an end part of the spool 21 passes without contacting an inner wall of the through-hole 66.

The plunger 7, which is a movable core and magnetic member, is made of iron based magnetic material and formed in a column shape (cross sectional shape is circular) by plastic working (cold forging or pressing). The plunger 7 is magnetized by the magnetic coil 3 exerting the magnetic force and attracted toward the attracting portion 65 of the stator core 6. The plunger 7 is provided with a sidewall portion 70 located at a portion opposed to the inner wall 60 of the stator core 6. The sidewall portion 70 is slidably held by an axial hole 67 which is formed in the inner wall portion 60 and whose cross sectional shape is circular. An axial end (left end surface in FIG. 1) of the plunger 7 is in point contact with a spherical end of the spool 21 of the solenoid valve 1. An outer circumferential surface of the sidewall portion 70 of the plunger 7 and/or an inner circumferential surface of the inner wall portion 60 of the stator core 6 are/is provided with non-magnetic material (for example, nickel-phosphorus plating, not shown) for securing a certain magnetic gap between the outer circumferential surface of the sidewall portion 70 and the inner circumferential surface of the inner wall portion 60. In the present embodiment, an entire outer circumferential surface of the sidewall 70 of the plunger 7 is coated with the non-magnetic material.

Next, an operation of the solenoid valve 1 according to the first embodiment is described with reference to FIGS. 1 to 5.

When current is not supplied to the magnetic coil 3, the spool rests at an initial position, where, for example, the axial end of the plunger 7 is in contact with a bottom surface of the bottom wall portion 52 of the yoke 5, in a state that the biasing force of the spring 22 is balanced with a hydraulic feedback force acting to the feedback hydraulic chamber 35 via the feedback port 35. At this time, pressure of operating oil supplied to the hydraulic servo 12 is maximum since the supply pressure hydraulic conduit 11 of the hydraulic pressure source 10 communicates with hydraulic circuit 13 via the supply pressure port 33, output pressure hydraulic chamber 37 and the clutch pressure output port 34.

When current is supplied to the magnetic coil 3, the magnetic coil 3 exerts the magnetic force so that magnetic flux flows in the magnetic circuit constituted by the plunger 7 and the attracting portion 65 of the stator core 6. Accordingly, the plunger 7 moves forward and pushes the spool 21 so that the spool 21 moves forward against the biasing force of.the spring 22 (compressing the spring 22).

The spool 21 and the plunger 7 move forward until and rest at a position where a leading end of the spool 21 comes in contact with the adjusting element 24. At this time, pressure of operating oil supplied to the hydraulic servo 12 via the hydraulic circuit 13 is minimum since the supply pressure hydraulic conduit 11 of the hydraulic pressure source 10 communicates with the second drain 17 via the supply pressure port 33, output pressure hydraulic chamber 37, the second drain port 32 and the drain hydraulic conduit 15.

In the solenoid portion 23 of the solenoid valve 1 according to the first embodiment, a fixed magnetic member holding the magnetic coil 3 and the coil bobbin 4 is divided into two components. One of the components is the cylindrical yoke 5 having the bottom, which is composed of the cylindrical outer wall portion 50, the annular thick body portion 51 and the annular bottom wall portion 52. The other one of the components is the cylindrical stator core 6 composed of the annular flange 62 and the cylindrical attracting portion 65. The first and second flange portions 41 and 42 are in contact with and axially supported by the yoke 5 and the stator core 6 from the opposite sides thereof so that the structure and the shape of the fixed magnetic member magnetized by energizing the magnetic coil 3 are optimized.

As a result, the expensive and complicated separable molding dies are not necessary for manufacturing the stator core 6 since the configuration of the stator core 6 is simple so that manufacturing cost of the stator core 6 is reduced without increasing the manufacturing cost of the yoke 5.

Further, if the fitting portion 56 of the yoke 5 and the fitting portion of the stator core 6, which are first fitting portions or contact portions, and the fitting portion 57 of the stator core 6 and the fitting portion 64 of the yoke 5, which are second fitting portions or contact portions, are finished with accurate dimensions, the magnetic gap between the inner circumferential surface of the yoke 5 and the outer circumferential surface of the stator core 6 is limited so that product performance of the solenoid portion 23 of the solenoid valve 1, that is, magnetic efficiency, is improved.

(Second Embodiment)

A method of manufacturing the solenoid valve according to a second embodiment is described with reference to FIGS. 6A to 8C.

Figures 6A, 6B, 6C, 6D:
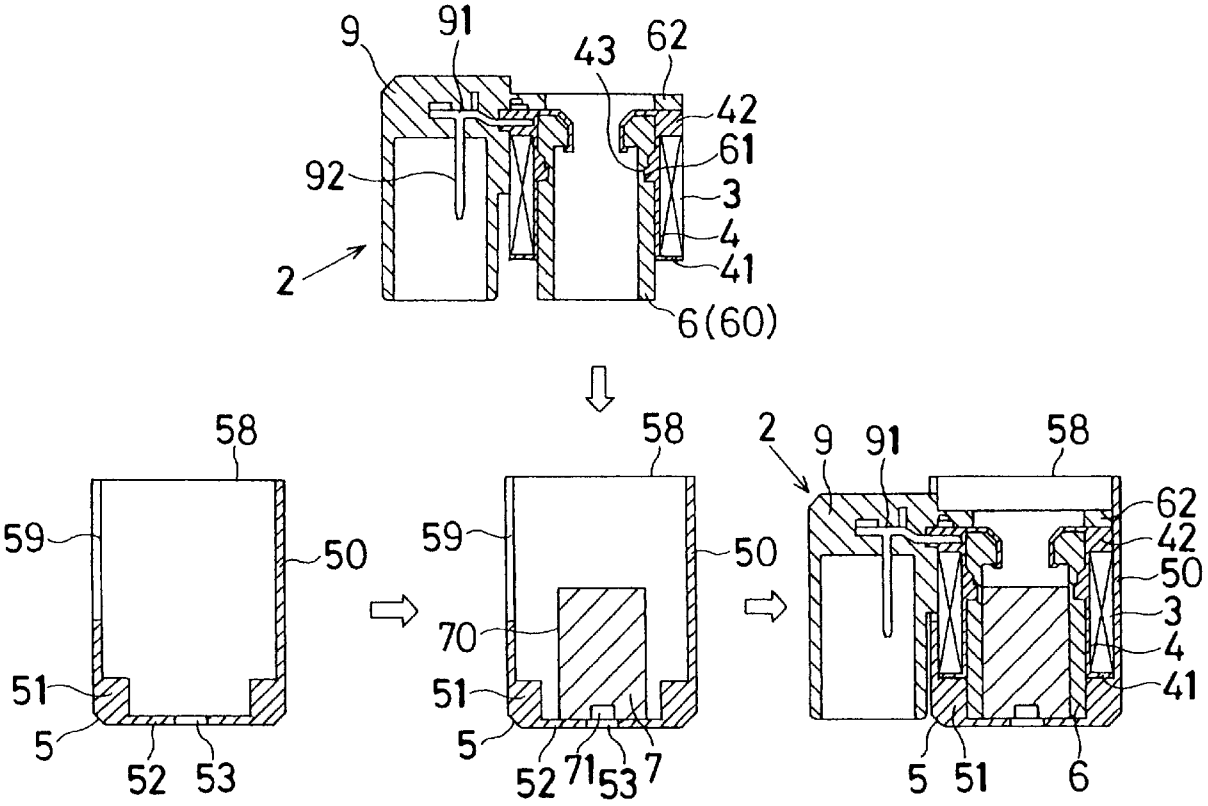
FIGS. 6A to 6D are sequential process views showing a manufacture of a solenoid valve according to a second embodiment.

As shown in FIG. 6A, the cylindrical yoke 5 having the bottom and the opening 58, which has the cylindrical outer wall 50, the annular thick body portion 51 and the annular bottom wall 52, is manufactured by plastically deforming (cold forging or pressing) the magnetic material to be magnetized due to magnetic force exerted on energizing the electromagnetic coil 3, that is, by putting the magnetic material between upper and lower molding dies having given cavity shapes (first manufacturing process). The annular bottom wall 52 is provided with the annular vent 53 for ventilation. The cylindrical outer wall 50 is provided with a notch 59 for exposing outside the electrically insulating resin connector 9 in which an outside connecting terminal 91 for connecting in circuit a wire end of the magnetic coil 3 and a vehicle power source such as a battery is embedded.

Next, the column shaped plunger 7 having the side wall portion 70 whose cross sectional shape is annular is manufactured by plastically deforming (cold forging or pressing) the magnetic material to be magnetized due to magnetic force exerted by the electromagnetic coil 3, that is, by putting the magnetic material between upper and lower molding dies having given cavity shapes (second manufacturing process). The plunger 7 is provided at an axial end thereof with a pin shaped hole 71 for positioning.

Further, the roughly cylindrical stator core 6, which has the cylindrical inner wall portion 60 and the ring shaped flange portion 62, is manufactured by plastically deforming (cold forging or pressing) the magnetic material to be magnetized due to magnetic force exerted by the electromagnetic coil 3, that is, by putting the magnetic material between upper and lower molding dies having given cavity shapes (third manufacturing process). The cylindrical inner wall portion 60 is provided at an outer circumference thereof with the circumferential groove 61 for housing the half dividable permanent magnet (not shown) or for rigidly holding a projecting portion 43 formed on the inner circumferential surface of the cylindrical portion 40 of the coil bobbin 4. The projecting portion 43 may be formed entirely or partly on the inner circumferential surface of the cylindrical portion 40. The sequential orders of the first to third manufacturing processes mentioned above may be adequately changed.

Next, as shown in FIG. 6B, the plunger 7 is assembled to the inside of the yoke 5 in such a manner that the plunger 7 is moved axially and inserted from the opening 58 of the yoke 5 toward the bottom wall portion 52 of the yoke 5 trough the inside of the outer wall portion 50 of the yoke 5 (fourth manufacturing process). The plunger 7 is inserted into and positioned in the inside of the yoke 5 in such a manner that a pin (not shown) protruding from the vent 53 for ventilation is fitted to the pin shaped hole 71 of the plunger 7 for positioning.

Next, the roughly cylindrical coil bobbin 4 (primary molding resin part), which has the cylindrical portion 40 and the pair of first and second flange portions 41 and 42, is formed by resin molding on the outer circumference of the inner wall portion 60 of the stator core 6 having the ring shaped flange 62 (primary resin molding process). Then, as shown in FIG. 6C, after the magnetic coil 3 is wound on the outer circumference of the cylindrical portion 40 between the pair of first and second flange portions 41 and 42 of the coil bobbin 4, the connector 9 (secondary molding resin part) is formed by resin molding on the outer circumference of the magnetic coil 3 so that a coil assembly 2 in which the stator core 6 is integrated into one body is manufactured (secondary resin molding process, fifth manufacturing process). A part of the terminal 91 protruding out of an inner wall of the connector 9 constitutes a connector pin 92 to be connected in circuit with a female connector (not shown) on a side of the vehicle power source.

Next, as shown in FIG. 6D, the coil assembly 2 is assembled to the inside of the yoke to complete the solenoid portion 23 of the solenoid valve 1 in such a manner that the coil assembly 2 integrated with the stator core 6 is axially moved and inserted from the opening 58 of the yoke 5 into a space between the inner circumferential surfaces of the outer wall portion 50 and the thick body portion 51 and the outer circumferential surface of the side wall portion 70 of the plunger 7 until the axial end of the inner wall portion 60 of the stator core 6 comes in contact with the bottom surface of the bottom wall portion 51 (sixth manufacturing process). In the coil assembly 2, the connector 9 having the terminal 91 formed by insert molding is exposed out of the notch 59 provided at the outer wall portion 50 of the yoke 5.

Figure 7C:
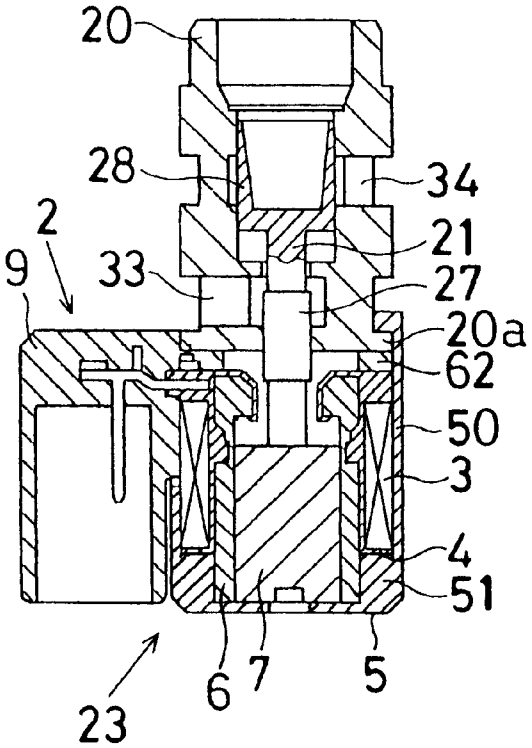
FIGS. 7A to 7C are another process views showing a manufacture of the solenoid valve according to the second embodiment.
Figure 7B:
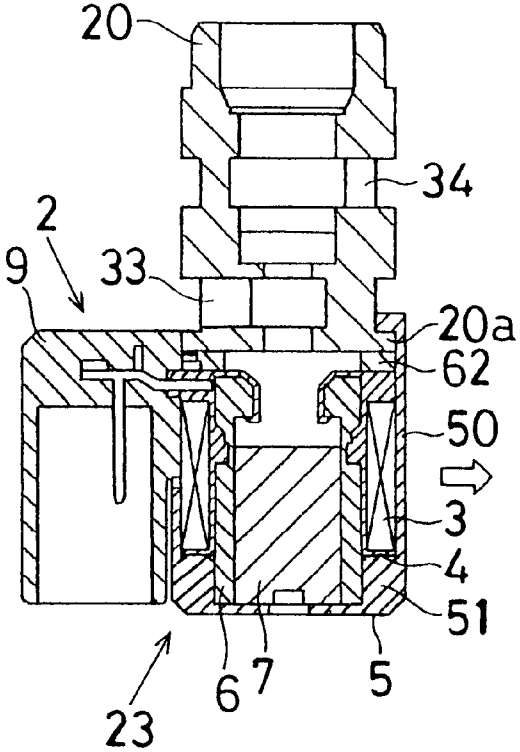
Figure 7A:
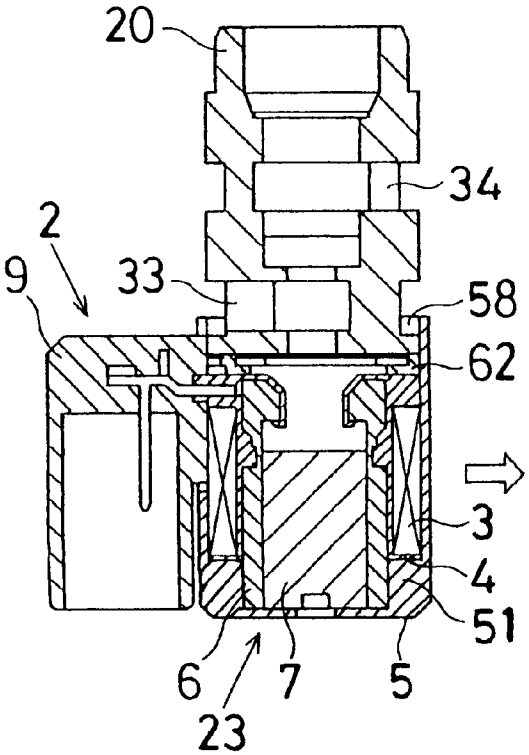

Next, as shown in FIG. 7A, an end part of the approximately cylindrical sleeve 20, which has the supply pressure port 33 and the clutch pressure outlet port 34, is inserted into the opening 58 of the yoke 5 of the solenoid portion 23 (seventh manufacturing process). Then, as shown in FIG. 7B, the solenoid portion 23 is assembled to the sleeve 20 by staking an end part of the outer wall portion 50 of the.yoke 5 to the flange portion 20*a* of the sleeve 20 (eighth manufacturing process). At this time, dimensions of the solenoid portion 23 and the sleeve 20 are checked.

Figures 8A, 8B, 8C:
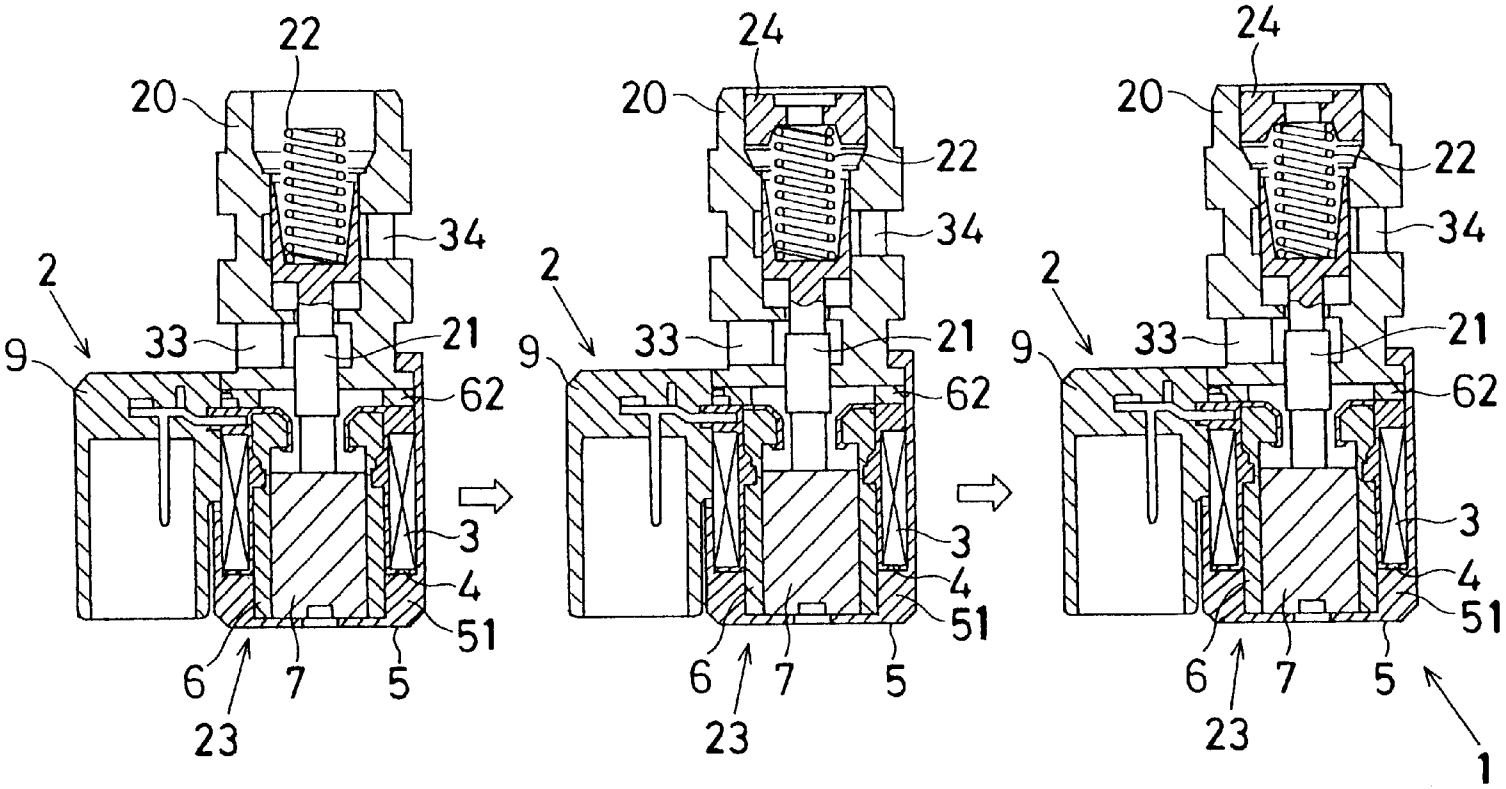
FIGS. 8A to 8C are further process views showing a manufacture of the solenoid valve according to the second embodiment.
Figure 9:
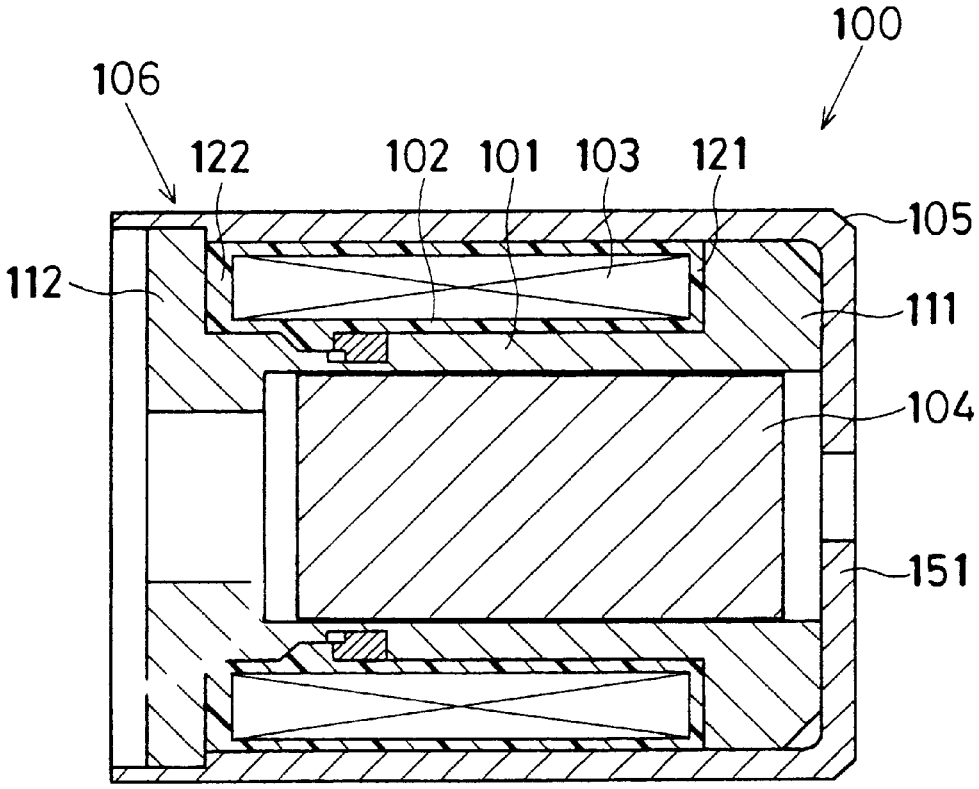
FIG. 9 PRIOR ART
FIG. 9 is a cross sectional view of a conventional electromagnetic actuator as a prior art.

Next, as shown in FIG. 7C, the pole shaped spool 21, which has the small diameter land 27 and the large diameter land 28, is inserted into the sleeve 20 (ninth manufacturing process). Then, as shown in FIG. 8A, the spring 22 is assembled to the other axial end part of the spool 21 (tenth manufacturing process). Further, as shown in FIG. 8B, the adjusting element 24 is assembled to the other axial end part of the sleeve 20 to achieve the solenoid valve 1 (eleventh manufacturing process). Furthermore, as shown in FIG. 8C, an axial dimension of the solenoid valve 1 is checked (twelfth manufacturing process). As mentioned above, all parts and components of the solenoid valve 1 are assembled from the same side, that is, from a side of the opening 58 of the yoke 5 so that the assembly working efficiency and productivity thereof are improved.

According to the embodiments mentioned above, the electromagnetic actuator is applied to the solenoid portion 23 of the solenoid valve 1 accommodated in the valve body in which the system hydraulic circuit for automatic transmission is formed. Further, the electromagnetic actuator of the present invention may be applied to any solenoid valve such as an electromagnetic fluid flow control valve by which fluid such as air, oil or water is controlled.

What is claimed is:

1. An electromagnetic actuator comprising:

a magnetic coil for generating magnetic force when energized;

a cylindrical resin molding member having first and second flange portions between which the magnetic coil is wound;

a moving core positioned at a radial inside of the resin molding member and axially movable due to the magnetic force generated on energizing the magnetic coil;

a first magnetic element to be magnetized by the magnetic force generated on energizing the magnetic coil, the first magnetic element being positioned at a radial outside of the magnetic coil and provided at an inner circumference of an axial end thereof with a first protruding portion extending radially inward; and a second magnetic element to be magnetized by the magnetic force generated on energizing the magnetic coil, the second magnetic element being disposed between a radial outside of the moving core and a radial inside of the magnetic coil and provided at an outer circumference of an axial end thereof on a side opposite to the axial end of the first magnetic element with a second protruding portion extending radially outward, wherein the other axial end of the first magnetic member is in contact with the second protruding portion, the other axial end of the second magnetic element is in contact with the first protruding portion, and the first and second flange portions are axially sandwiched between and supported by the first and second protruding portions.

2. An electromagnetic actuator according to claim 1, wherein the first magnetic element is provided at the other axial end thereof with an opening whose inner circumference is closely fitted to an outer circumference of the second protruding portion and the first protruding portion is provided in a center thereof with an inner recess whose inner circumference is closely fitted to an outer circumference of the second magnetic element.

3. An electromagnetic actuator as in claim 1, wherein the other axial end of the first magnetic element is in contact with the outer circumference of the second protruding portion and the other axial end of the second magnetic element is in contact with the inner circumference of the first protruding portion.

4. An electromagnetic actuator as in claim 1, wherein said first magnetic element has a cylindrical outer wall positioned at the radial outside of the magnet coil, an annular thick body portion defining said first protruding portion in contact with the first flange portion of the molding member, and an annular bottom wall for substantially closing an axial end of the outer wall.

5. An electromagnetic actuator as in claim 4, wherein the other axial end of the second magnetic member axially abuts said bottom wall of said first magnetic member.

6. An electromagnetic actuator as in claim 1, wherein the other axial end of the first magnetic element is secured to a housing of a solenoid valve by staking.

7. An electromagnetic actuator as in claim 6, wherein said second magnetic element second protruding portion of said second magnetic element is axially sandwiched between said second flange portion of said cylindrical resin molding member on one side and the housing of the solenoid valve on the other side.

8. An electromagnetic actuator as in claim 1, wherein a circumferential groove is defined in said second magnetic element in a surface of the second magnetic element facing the magnetic coil.

9. A method of manufacturing an electromagnetic actuator having a magnetic coil, a yoke, a moving core and a fixed core, comprising steps of:

plastically deforming magnetic material to be magnetized by magnetic force exerted on energizing the magnetic coil so that the yoke is formed in shape of a cylinder having a bottom at an axial end and an opening at the other axial end;

plastically deforming magnetic material to be magnetized by magnetic force exerted on energizing the magnetic coil so that the moving core is formed in a given shape;

plastically deforming magnetic material to be magnetized by magnetic force exerted on energizing the magnetic coil so that the fixed core is formed in a given shape;

axially moving and inserting the moving core into an inside of the yoke from the opening of the yoke toward the bottom thereof so that the moving core is assembled to the yoke;

forming a primary resin part having first and second flange portions on an outer circumference of the fixed core by integral resin molding;

winding the magnetic coil on the primary resin part between the first and second flange portions;

forming a secondary resin part over an outer circumference of the magnetic coil by integral resin molding so that a coil assembly, in which the magnetic coil and the primary and secondary resin parts are integrated with the fixed core, is completed; and axially moving and inserting the coil assembly into a space between an inner circumference of the yoke and an outer circumference of the moving core from the opening of the yoke toward the bottom thereof so that the coil assembly is assembled to the yoke.

10. An electromagnetic actuator comprising:

a magnetic coil for generating magnetic force when energized;

a cylindrical resin molding member having first and second flange portions between which the magnetic coil is wound;

a moving core positioned at a radial inside of the resin molding member and axially movable due to the magnetic force generated on energizing the magnetic coil;

a first magnetic element to be magnetized by the magnetic force generated on energizing the magnetic coil, the first magnetic element being positioned at a radial outside of the magnetic coil and provided at an inner circumference of an axial end thereof with a first protruding portion extending radially inward; and a second magnetic element to be magnetized by the magnetic force generated on energizing the magnetic coil, the second magnetic element being disposed between a radial outside of the moving core and a radial inside of the magnetic coil and provided at an outer circumference of an axial end thereof on a side opposite to the axial end of the first magnetic element with a second protruding portion extending radially outward, wherein the first and second flange portions are axially sandwiched between and supported by the first and second protruding portions, and wherein the first magnetic element is provided at the other axial end thereof with an opening whose inner circumference is closely fitted to an outer circumference of the second protruding portion and the first protruding portion is provided in a center thereof with an inner recess whose inner circumference is closely fitted to an outer circumference of the second magnetic element.

* * * * *